US007328974B2

(12) United States Patent
Wang

(10) Patent No.: US 7,328,974 B2
(45) Date of Patent: Feb. 12, 2008

(54) INKJET PRINTER INK CARTRIDGE

(76) Inventor: Alex Kuo-Shen Wang, 8658 Panuco Way, Las Vegas, NV (US) 98147

( * ) Notice: Subject to any disclaimer, the term of this patent is extended or adjusted under 35 U.S.C. 154(b) by 323 days.

(21) Appl. No.: 11/241,113

(22) Filed: Sep. 29, 2005

(65) Prior Publication Data

US 2007/0070157 A1 Mar. 29, 2007

(51) Int. Cl.
*B41J 2/14* (2006.01)
*B41J 2/175* (2006.01)

(52) U.S. Cl. ..... 347/50; 348/87

(58) Field of Classification Search ..... 347/20, 347/50, 58, 61, 65, 66, 87
See application file for complete search history.

(56) References Cited

U.S. PATENT DOCUMENTS 4,929,969 A * 5/1990 Morris ..... 347/87
4,953,287 A * 9/1990 West et al. ..... 29/611
5,148,185 A * 9/1992 Abe et al. ..... 347/65
6,039,439 A * 3/2000 Komplin et al. ..... 347/65
6,305,786 B1 * 10/2001 Plotkin et al. ..... 347/50
6,543,887 B2 * 4/2003 Chang et al. ..... 347/87

* cited by examiner

*Primary Examiner*—Anh T. N. Vo
(74) *Attorney, Agent, or Firm*—Pro-Techtor Int'l Services

(57) ABSTRACT

The present invention relates to an inkjet printer ink cartridge, which configures a sponge-free ink-filling device into a combined structure of a case and an ink outlet base body, which is then attached onto a printed circuit by PECVD. A stand having a recess on the ink outlet base body thereon can be used to dispose a socket. A nozzle plate connected to a heater chip can be inserted to the socket therein. The heater chip is electrically connected to a heating element in airflow guides formed on a surface of the socket thereto. A vertical wire attached to the socket is electrically connected to the vertical wire bent on the printed circuit at an edge of the stand. Therefore, when the heater chip has been used for some time and is required to be replaced, only the nozzle plate and the heater chip are independently replaced, whereas the case and the ink outlet base body can both be repeatedly used. For example, when short circuit occurs on the printed circuit, or ink is soaked into the printed circuit, only the ink outlet base body is required to be replaced, whereas the case can still be repeatedly used, so as to cut costs and achieve environmental protection.

4 Claims, 3 Drawing Sheets

INKJET PRINTER INK CARTRIDGE

BACKGROUND OF THE INVENTION (a) Field of the Invention

The present invention relates to an inkjet printer ink cartridge, more particularly, to an inkjet printer ink cartridge having an ink outlet base body that can be demounted from a case, whereas a nozzle plate and a heater chip inserted into the ink outlet base body thereon can be independently demounted and replaced, so the ink storing case can be repeatedly used without any need of replacement, thereby cutting costs and achieving environmental protection.

(b) Description of the Prior Art

Referring to FIG. 4, an ink cartridge 100 comprising an ink container 101 for storing ink, and an ink ejector 103 (as shown on the top of FIG. 4) is disposed at a bottom 102 of the ink container 101, ejecting the ink from the ink container 101 in order to achieve inkjet printing thereby having the ink printed on the document. The ink ejector 103 comprises a combined structure of a nozzle plate 1031 and a heater chip, a soft printed circuit board 1032, and a guiding module (not shown in the drawing) formed on a lower portion of the printed circuit board 1032. Therefore, ink is ejected from a nozzle 1033 formed on the nozzle plate 1031 onto the to-be-printed document.

As the nozzle plate 1031 and the printed circuit board 1032 are directly attached to the ink cartridge 100 thereon, they combine with the ink cartridge 100 into one unit. Therefore, when the heater chip has been used for some time and is unable to be actuated, it is necessary to have the heater chip replaced. Moreover, when wires bonded and connected onto the printed circuit board 1032 thereon are so fragile that they are broken, or the printed circuit board is soaked by ink to cause a short circuit; the entire ink cartridge 100 is unable to be used again and is required to be discarded, which not only waste costs but also cause environmental pollution problems.

SUMMARY OF THE INVENTION

A primary object of the present invention is to provide a case and an ink outlet base body, both of which are demountable. The combined structure of a nozzle plate and a heater chip is then inserted into the ink outlet base body, by means of a socket. Therefore, when the heater chip has been used for some time and is required to be replaced, only the combined structure of nozzle plate and heater chip is independently replaced. When a short circuit occurs on the printed circuit disposed on the ink outlet base body or the printed circuit thereof is soaked in ink, only the ink base body is replaced, so the case can still be used without any need of replacement, in order to cut costs and achieve environmental protection.

DETAILED DESCRIPTION OF THE PREFERRED EMBODIMENTS

Figure 1:
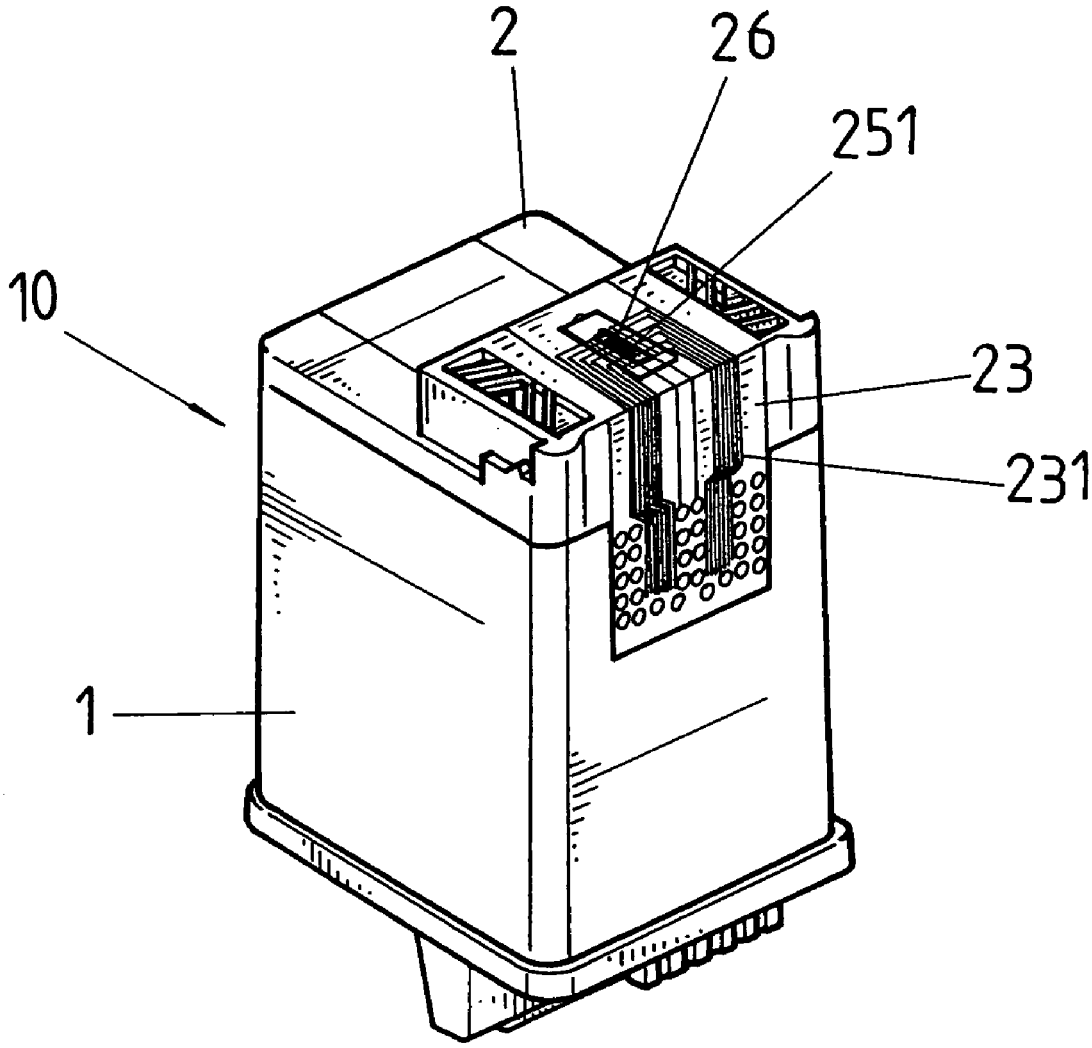
FIG. 1 shows a general view according to the present invention.
Figure 2:
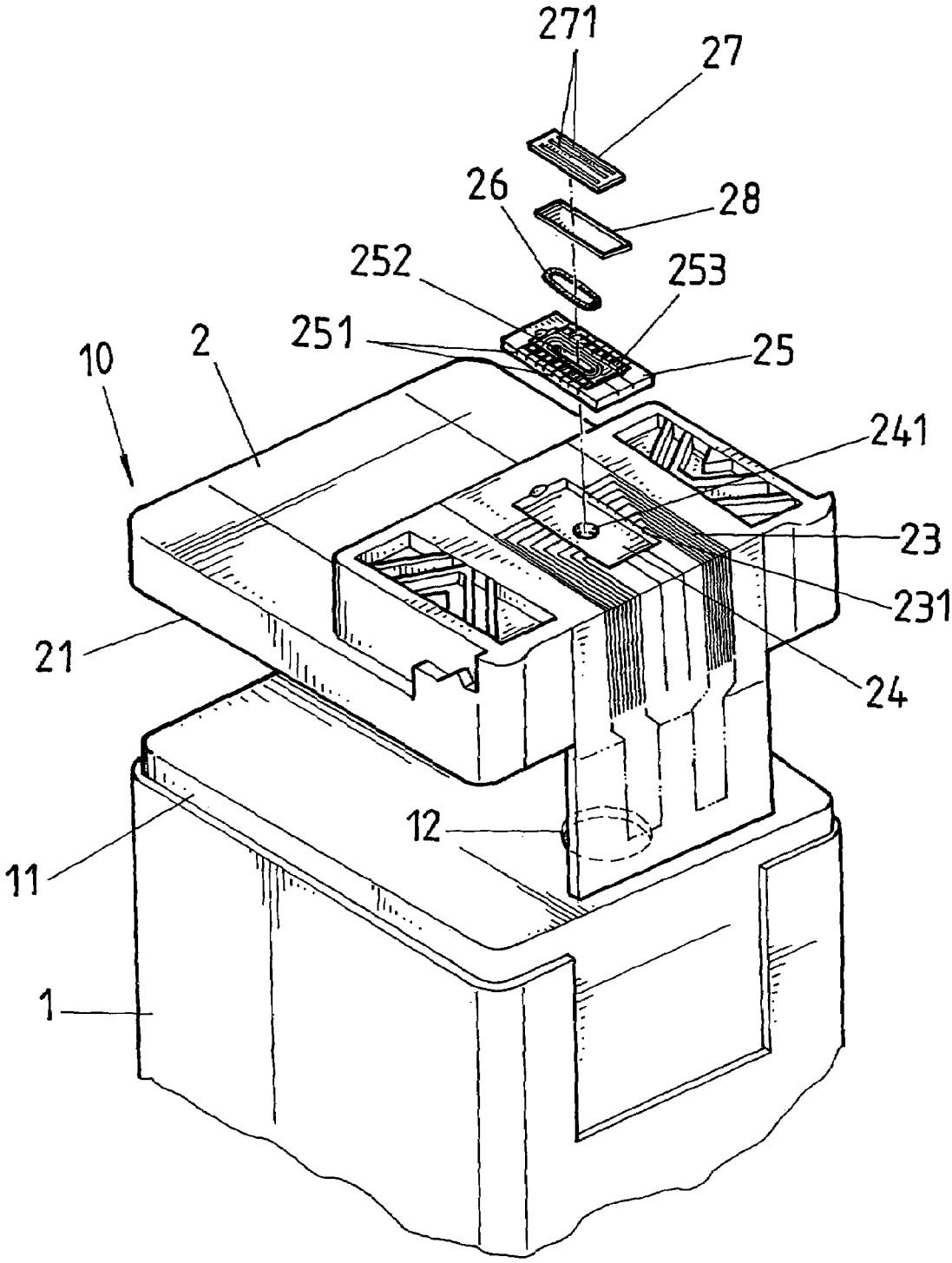
FIG. 2 shows an exploded view according to the present invention.
Figure 3:
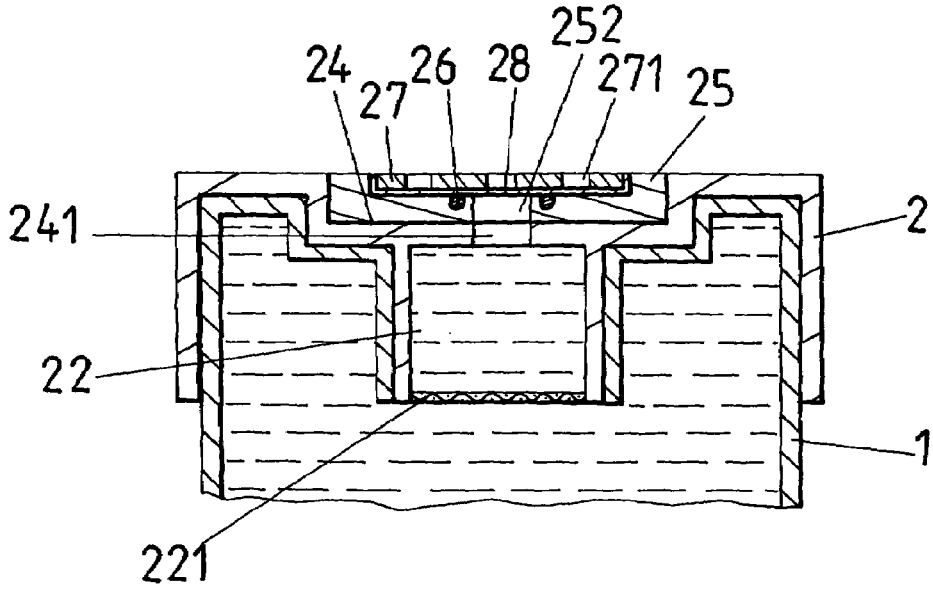
FIG. 3 shows a cross sectional schematic view according to the present invention.
Figure 4:
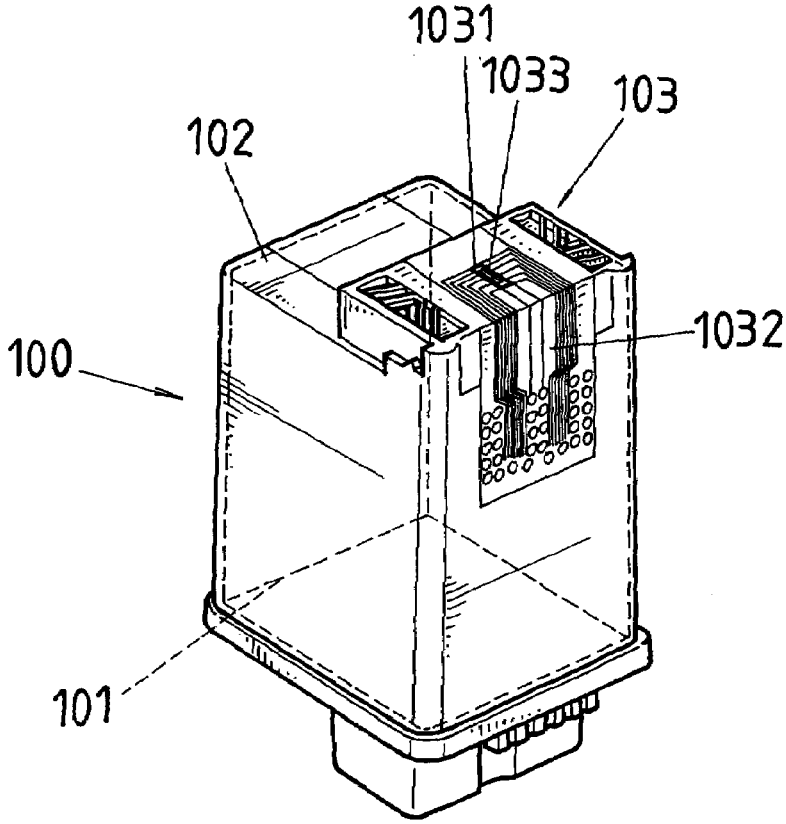
FIG.4 (PRIOR ART)
FIG. 4 shows a general view of a conventional product.

Referring to FIGS. 1~3, an ink cartridge 10 of the present invention is applied to a sponge-free ink-filling device, which comprises a combined structure of a case 1 and an ink outlet base body 2. An inlay rim 11 having a recess therein encircles a periphery of a base (that is the top of the drawings) of the case 1 and can be inserted into a n-shaped groove 21 of the ink outlet base body 2. Moreover an ink outlet 12 disposed at the base of the case 1 communicates with an ink inlet 22 of the ink outlet base body 2. Whereas, a filter 221 is disposed on an exterior of the ink inlet 22. A printed circuit 23 is attached onto the ink outlet base body 2 applied by Plasma Enhanced Chemical Vapor Deposition (PECVD.)

Referring to FIG. 2, a base of the ink outlet base body 2 comprises a stand 24 having a recess therein, and then an ink outlet 241 in a center of the stand 24 communicates with the ink inlet 22 at another end thereof (as shown in FIG. 3.) An edge of the stand 24 starts from a vertical wire 231 bent by the printed circuit 23 and is vertical to the printed circuit 23. An interior of the stand 24 can be used for inserting a socket 25,such that a vertical wire 251 attached to an edge of the socket 25 is then electrically connected to the wire 231 attached to the edge of the stand 24,whereas a seal ring 26 encircles a periphery of an ink outlet 252 of the socket 25. A heater chip 28 attached to an end of a nozzle plate 27 is electrically connected to a heating element in a plurality of airflow guides formed on a surface of the socket 25. When an ink cartridge 10 receives a printing command, which is then transmitted to the heater chip 28, and then actuates the heating element to heat the ink in the airflow guides 253, based on the printing command received, thereby ejecting from a nozzle 271 on the nozzle plate 27, in order to achieve inkjet printing.

An ink outlet 12 at the base of the case 1 can fill ink into the ink container 101 therein, by means of an ink-filling instrument, so that the ink cartridge 10 can be repeatedly used.

The ink outlet base body 2 can demount the nozzle plate 27 and the connected heater chip 28, such that the ink-storing case 1 and a housing of the ink outlet base body 2 can both be repeatedly used. Therefore, when short circuit occurs on the printed circuit 23 or ink is carelessly soaked onto the printed circuit 23, only the ink outlet base body 2 is required to be 10 replaced, whereas the case 1 can still be repeatedly used, without any need of replacement, thereby achieving environmental protection and cost benefits.

In summary, the present invention relates to a structure formed by combining the case1 and the ink outlet base body 2, wherein the nozzle plate 27 on the ink outlet base body 2 thereon is combined with the heater chip 28 by inserting the socket 25 into the ink outlet base body 2. Therefore, when the heater chip 28 has been used for some time and is unable to be used again, only the nozzle plate 27 that is combined to the heater chip 28 is demounted and replaced. When there is a short circuit occurs on the printed circuit 23 attached to the ink outlet base body 2 or ink is soaked into the printed circuit 23, only the ink outlet base body 2 is independently replaced, whereas the ink storing case can still be repeatedly used, so as to cut costs and achieve environmental protection.

It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. An inkjet printer ink cartridge, comprising:

a case having an inlay rim disposed on a periphery thereof, with an ink outlet being disposed on a first bottom thereof;

an assembled ink outlet base body having a groove capable of being inserted on the inlayrim of the case wherein then an end of an ink inlet communicates with the ink outlet of the case; a printed circuit is attached to an outer rim of the ink outlet base body thereof; a stand having a recess is disposed on a second bottom thereof; a first wire bent by the printed circuit is disposed on a rim of the stand;

a socket capable of being inserted into the stand of the ink outlet base body, a second wire attached to the socket is electrically connected to the first wire of the stand; an ink outlet disposed in a center of the stand communicates with the ink inlet of the ink outlet base body; a heating element is disposed in a plurality of airflow guides formed on a surface of the socket thereof;

a nozzle plate capable of being inserted in the socket having a nozzle disposed thereof;

a heater chip attached to an end periphery of the nozzle plate is electrically connected to the heating element in the airflow guides on a surface of the socket;

the assembled ink outlet base body can be demounted from the case, and the nozzle plate having a heater chip attached thereto can also be demounted from the socket and then replaced.

2. The inkjet printer ink cartridge according to claim 1, wherein a seal ring encircles a periphery of an ink outlet in the center of the socket.

3. The inkjet printer ink cartridge according to claim 1, wherein a filter is disposed on an exterior of the ink inlet of the ink outlet base body of the socket.

4. The inkjet printer ink cartridge according to claim 1, wherein the printed circuit is attached to the ink outlet base body of the socket by Plasma Enhanced Chemical Vapor Deposition (PECVD).

* * * * *